US010046780B2

(12) United States Patent
Dymek et al.

(10) Patent No.: US 10,046,780 B2
(45) Date of Patent: Aug. 14, 2018

(54) OPERATION OF A RAIL VEHICLE BY MEANS OF AN ETCS DEVICE

(71) Applicant: SIEMENS AKTIENGESELLSCHAFT, Munich (DE)

(72) Inventors: Markus Dymek, Berlin (DE); Carsten Hasselkuss, Berlin (DE); Udo Rabeneck, Lehrte (DE); Christian Wilke, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 46 days.

(21) Appl. No.: 14/428,068

(22) PCT Filed: Sep. 5, 2013

(86) PCT No.: PCT/EP2013/068322

§ 371 (c)(1),
(2) Date: Mar. 13, 2015

(87) PCT Pub. No.: WO2014/040892

PCT Pub. Date: Mar. 20, 2014

(65) Prior Publication Data

US 2015/0239481 A1 Aug. 27, 2015

(30) Foreign Application Priority Data

Sep. 14, 2012 (DE) ..... 10 2012 216 405

(51) Int. Cl.
*B61L 15/00* (2006.01)
*B61L 27/00* (2006.01)

(52) U.S. Cl.
CPC ..... *B61L 15/0063* (2013.01); *B61L 15/0027* (2013.01); *B61L 27/0038* (2013.01); *B61L 27/0066* (2013.01); *B61L 2027/0044* (2013.01)

(58) Field of Classification Search
None
See application file for complete search history.

(56) References Cited

U.S. PATENT DOCUMENTS 4,327,415 A 4/1982 Rush et al.
5,404,465 A * 4/1995 Novakovich ..... B61L 15/0063 710/110

(Continued)

FOREIGN PATENT DOCUMENTS

DE 102004001819 A1 8/2005
EP 1614604 A1 1/2006

(Continued)

OTHER PUBLICATIONS

WO 2009027380 A1 machine english translation (Espacenet).*

(Continued)

*Primary Examiner* — Ryan Rink
*Assistant Examiner* — Paul A Castro
(74) *Attorney, Agent, or Firm* — Laurence Greenberg; Werner Stemer; Ralph Locher

(57) ABSTRACT

A method for operating a rail vehicle includes, at least to some extent, using a secondary ETCS device which travels along with the rail vehicle but is not used for its operation, if a fault occurs in a primary ETCS device. A secondary EVC takes over the role of a primary EVC and, in many applications, at least some train control functions. The advantage is that train control can, at least in some fault cases, be continued in an automated way in the case of a failure of a component of the primary ETCS device. A rail vehicle and an apparatus for the operation of a rail vehicle are also provided.

15 Claims, 1 Drawing Sheet

(56) References Cited

U.S. PATENT DOCUMENTS

| | | | | |
|---|---|---|---|---|
| 6,694,231 | B1 * | 2/2004 | Rezk | B61L 25/045 701/19 |
| 2004/0093196 | A1 * | 5/2004 | Hawthorne | B61L 3/125 703/8 |

FOREIGN PATENT DOCUMENTS

| | | | | |
|---|---|---|---|---|
| EP | 2253525 | A1 | 11/2010 | |
| WO | 2008040385 | A1 | 4/2008 | |
| WO | WO2009027380 | A1 * | 3/2009 | B61L 15/0027 |

OTHER PUBLICATIONS

Burkert S., et al., "Redundanzkonzept der Betriebsleittechnik fuer den Transrapid"/"Redundancy Concept for the Operations Control System of the Transrapid Maglev High-Speed Train," Signal + Draht, Telzlaff Verlag GmbH, Darmstadt; vol. 88, No. 5; May 1996, pp. 20-23.

Hachiga A., et al., "The Design Concepts and Operational Results of Fault-tolerant Computer Systems for the Shinkansen Train Control," Falut-Tolerant Computig, 1993m, FTCS-23,m Digest of Papers, The 23th International Symposium on Toulouse, France, Jun. 22-24, 1993, Los Alamitos, CA, USA, IEEE Comput. Soc. Jun. 22, 1993, pp. 78-87.

* cited by examiner

OPERATION OF A RAIL VEHICLE BY MEANS OF AN ETCS DEVICE

BACKGROUND OF THE INVENTION

Field of the Invention

The invention relates to a method for the operation of a rail vehicle by means of a secondary ETCS device if a fault occurs in the primary ETCS device. Accordingly, a rail vehicle and an apparatus are also proposed.

The European Train Control System (ETCS for short) is one component of the European Rail Traffic Management System which was developed under the acronym ERTMS. The second technical component of this digital rail technology is the railway mobile radio communication system GSM-R. ETCS is intended to replace the plurality of individual train control systems used in individual countries.

ETCS assumes several functions. It monitors the local speed limit, the maximum speed of the train, the correct route of the train, the direction of travel, the suitability of the train for the route and compliance with special operating regulations.

This information is processed by the modules of the ETCS:

- trackside the Eurobalises or Euroloops laid on the track at ETCS Level 1, and at ETCS Level 2 and 3 the ETCS Radio Block Center (RBC) connected to the signal box,
- on the vehicle side the ETCS On-Board Unit (OBU), which evaluates the data received, displays it for the train driver and automatically brings the train to a halt before a hazard in the event of danger.

The ETCS vehicle device (also referred to as the ETCS device) essentially comprises the ETCS computer (also referred to as "EVC", European Vital Computer), driver's cab display (DMI, Driver Machine Interface), position sensor, GSM-R transmission device (including Euroradio), balise reader and brake access.

Apart from the ETCS Levels, ETCS modes are also defined. The modes describe the conditions which the EVC may encounter. An overview can be found e.g. at http://de.wikipedia.org/wiki/ETCS.

The ETCS vehicle device is not fully redundant in design. Consequently, individual failures in the EVC hardware and in connected components, such as e.g. the balise antenna, result in complete system failure. As a rule, the ETCS vehicle device switches to the "system failure" state and is isolated as a result. Insofar as there is no fully redundant equipment on the vehicle side and trackside, in this case a functional system is no longer available for vehicle control.

On the one hand, equipment of routes and rail vehicles with redundant systems is known. Thus, in addition to the ETCS devices, second train control levels of national systems are employed. National train control systems are available on the vehicles and can be operated in the conventional manner as standalone systems if the ETCS system is isolated.

On the other hand, there are operational regulations for driving without a monitoring train control system in which staff are responsible for operation.

The task of the invention is to avoid the aforementioned disadvantages and in particular also to provide automated support for train control as far as possible in the event of failure of ETCS hardware.

BRIEF SUMMARY OF THE INVENTION

This object is achieved according to the features of the independent claims. In particular, preferred embodiments can be found in the dependent claims.

To achieve the object a method is proposed for the operation of a rail vehicle,

- which has a primary ETCS device with a primary computer and a secondary ETCS device with a secondary computer,
- in which, if a fault occurs in the primary ETCS device, switching takes place from the primary computer to the secondary computer,
- in which the secondary computer is used to operate the rail vehicle.

The computer comprises a processing component, a computer, a microcontroller or a plurality of these elements. The computer itself can also be redundant or distributed in design. The computer is in particular an on-board computer of a carriage of the rail vehicle. The computer is also referred to in exemplary fashion here as an EVC or ETCS computer and/or may be part of such a computer.

The primary computer and/or the primary ETCS device are normally used for the operation of the rail vehicle. If a fault occurs, a train control function—if necessary, limited—can still be ensured by means of the secondary computer (and/or at least part of the secondary ETCS device) then activated. The advantage of this is that at least in the case of some faults, train control can still continue in an automated manner if one component of the primary ETCS device fails.

It should be noted that the rail vehicle (also referred to as "train") has at least one carriage, wherein the carriage may be a traction vehicle, a passenger car, a freight car or a combination of such compartments or functions. The traction vehicle has a driver's cab (also referred to as operator station) and can be designed with or without propulsion. In particular, the traction vehicle may be a locomotive. The ETCS device is preferably arranged in a carriage of the rail vehicle.

Furthermore, it is noted that the rail vehicle may have several secondary ETCS devices (each with a computer) and that if necessary a (secondary) computer can be activated from these multiple secondary ETCS devices.

A development is that the fault comprises at least one of the following options:

- a failure of a component of the primary ETCS device;
- a fault message concerning the primary ETCS device.

Another development is that

- the primary ETCS device is switched in isolation if a fault occurs,
- the secondary computer is switched from a "sleeping" state to an active state.

In particular, it is a development that

- the rail vehicle is slowed down if a fault occurs,
- when the rail vehicle is at a standstill, the primary ETCS device is switched in isolation by means of ETCS isolation switches and an ETCS Level 2 connection to an ETCS radio block center is interrupted at least partially, in particular except for a recording unit and a driver's cab display,

- the secondary computer is activated and used for the operation of the rail vehicle in connection with the driver's cab display of the primary ETCS device.

Insofar as the driver's cab display in the carriage of the rail vehicle with the primary ETCS device was not the cause of the system fault and is still functional, the function of vehicle control in connection with this driver's cab display is assumed, for example, by the secondary computer.

It is also a development that the primary ETCS device is switched in isolation and this isolation is signaled to the secondary computer, in particular via a bus system, a circuit or a radio connection.

As a result of this signaling, the secondary computer can be activated and used for the operation of the rail vehicle.

Furthermore, it is a development that the secondary computer is used for the operation of the rail vehicle by providing at least one of the following functionalities:

monitoring of the highest permissible speed of the rail vehicle, monitoring of the highest permissible speed of the route, in particular based on external specifications.

A next development is that in the event that the route and the rail vehicle are equipped for ETCS Level 2, the secondary computer provides the same modes in ETCS Level 2 as the computer of the isolated primary ETCS device and communicates with the ETCS radio block center on the basis of the radio transmission device, in particular the GSM-R radio transmission device.

In this connection, the secondary computer can ensure the full backup functionality of the rail vehicle.

One embodiment is that for the operation of the rail vehicle, the secondary computer uses a first balise antenna at the head of the rail vehicle with regard to its direction of travel.

In this case too, the secondary computer can ensure the full backup functionality of the rail vehicle.

An alternative embodiment is that if the balise antenna at the head of the rail vehicle cannot be used, the secondary computer uses another balise antenna of the rail vehicle for the operation of the rail vehicle.

For example, in ETCS Level 2 mode the distance from the balise antenna to the head of the rail vehicle (this is known due to the composition of the rail vehicle) can be considered as a fixed interval (offset). Thus, this interval can be processed by the second computer when controlling the rail vehicle and a distance adjusted by the interval reported to the ETCS radio block center. In this respect, the second computer provides transparent processing of the data for the ETCS radio block center.

The next embodiment is that the secondary computer, in particular in ETCS Level 1 mode, provides reduced backup functionality for operation of the rail vehicle.

The reduced backup functionality in particular requires monitoring of operation by the rail-car driver. For example, speed monitoring (of the maximum speed of the rail vehicle and/or the temporary speed restriction) can be provided with reduced backup functionality; in this case responsibility for monitoring of speed lies with the rail-car driver.

The embodiments concerning the method apply accordingly to the other claim categories.

The aforementioned object is also achieved by a rail vehicle with a primary ETCS device having a primary computer, with a secondary ETCS device having a secondary computer, wherein if a fault occurs in the primary ETCS device, the primary ETCS device can be switched to inactive, wherein if a fault occurs the secondary computer can be activated and used for operation of the rail vehicle.

In addition, the object above is achieved by means of an apparatus for the operation of a rail vehicle which is configured such that if a fault occurs in a primary ETCS device, the apparatus receives an activation message and can be activated and used for operation of the rail vehicle after the primary ETCS device has been switched off.

The apparatus may be the secondary ETCS device, in particular the secondary computer of this secondary ETCS device.

Furthermore, the solution presented here comprises a computer program product which can be loaded directly into the memory of a digital computer, comprising program code parts which are suitable for performing steps of the method described here.

Furthermore, the aforementioned problem is solved by means of a machine-readable storage medium, e.g. any memory, comprising instructions which can be executed by a computer (e.g. in the form of program code), which are suitable for the computer to perform steps of the method described here.

The aforementioned properties, features and advantages of this invention and the manner in which they are achieved become clearer and more precisely understandable in connection with the following schematic description of exemplary embodiments which are explained in more detail with reference to the diagrams. In the process, the same elements or elements producing the same effect can be given the same reference characters for the sake of clarity.

BRIEF DESCRIPTION OF THE SEVERAL VIEWS OF THE DRAWING

The diagrams show

DESCRIPTION OF THE INVENTION

For rail vehicles with several ETCS vehicle devices which are electrically connected, a secondary EVC which was in "sleeping" mode until then assumes the function of vehicle control after and/or for isolation of the leading active EVC (i.e. the primary EVC, also referred to as ETCS computer).

It should be noted that primary EVC and secondary EVC are only selected as exemplary illustrative terms to show that one of the computers (the primary EVC) was active previously and is at least partially replaced by the other computer (the secondary EVC). Accordingly, the primary EVC is part of the primary ETCS device and the secondary EVC is part of the secondary ETCS device. Preferably, several ETCS devices are provided in one rail vehicle, for example in various carriages of the rail vehicle.

Thereby, at least part of the automated train control, in particular the ETCS functionality, can be maintained.

Depending on the vehicle and route design, backup functions are maintained to varying degrees.

If a fault which necessitates a change to "system failure" mode occurs in the primary ETCS device then the rail vehicle is slowed down, for example, and when at a standstill this faulty primary ETCS device is isolated by means of ETCS isolation switches. All the backup functions associated with the ETCS device are deactivated as a result. A connection to the RBC available in ETCS Level 2 is interrupted. The component recording unit (Juridical Recorder, JRU) and driver's cab display (Driver Machine Interface, DMI) are preferably not affected by such isolation.

Insofar as the driver's cab display in the carriage of the rail vehicle with the primary ETCS device was not the cause of the system failure and is still functional, for example, the secondary EVC assumes the function of vehicle control after a mode switch in connection with this driver's cab display.

The isolation of the primary EVC is signaled to the secondary ("sleeping") EVC (ETCS systems and thus their EVCs are electrically connected). Depending on the design of the rail vehicle, this signaling is realized via a bus system (MVB, Profinet, CAN), a circuit or a radio connection.

The secondary EVC quits the "sleeping" mode and assumes the backup functions of the rail vehicle. The extent of these backup functions may vary and ranges e.g. from straightforward supervision of maximum speed through to full train supervision.

Figure 1:
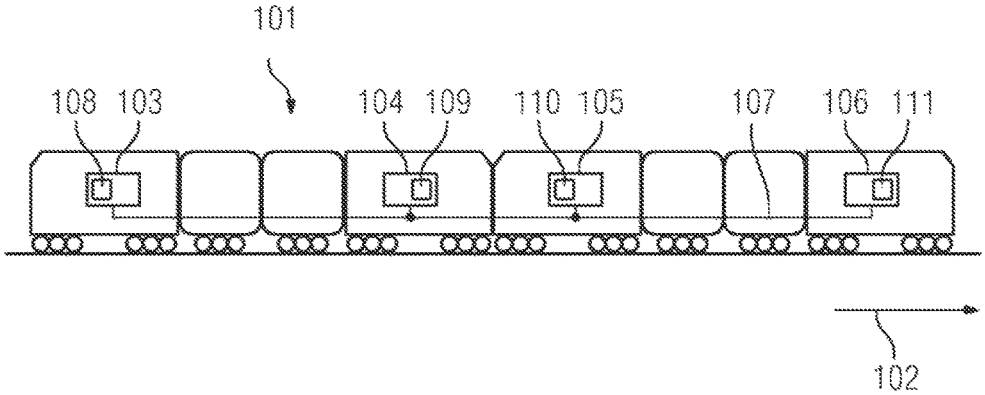
FIG. 1 a diagrammatic view of a rail vehicle with a plurality of carriages, some of which have ETCS devices with EVCs.

FIG. 1 shows a diagrammatic view of a rail vehicle 101 with a plurality of carriages, some of which have an ETCS device 103 to 106. Each of the ETCS devices 103 to 106 has, inter alia, a computer 108 to 111 (also referred to as EVC). The rail vehicle 101 is moving in the direction of travel 102, before the occurrence of the fault the ETCS device 106 is active, the other ETCS devices 103 to 105 are inactive, e.g. in the "sleeping" state. If a fault occurs in the ETCS device 106, this is at least partially switched to an inactive state and for example, the computer 110 takes over the ETCS device 105. The computers 108 to 111 and/or the ETCS devices 103 to 106 are connected in exemplary fashion via a bus 107 in FIG. 1.

The following scenarios can be distinguished advantageously:

(a) Scenario 1:

The route and rail vehicle are equipped for ETCS Level 2, the secondary EVC and the driver's cab display are connected to each other via a bus.

The secondary EVC provides the same modes in ETCS Level 2 as the primary (previously active) EVC and establishes a connection to the RBC via GSM-R.

If there is access to the data of the balise antenna at the head of the rail vehicle (via a separate and/or offset balise channel), the backup functions can be provided and/or maintained in full.

However, if there is no access to this data, the data e.g. of the local balise antenna of the carriage in which the secondary EVC is located are used. The backup function is therefore limited because the data is captured too late (not at the head of the vehicle). In other words, the head of the rail vehicle has passed over the balise long before the local balise antenna receives the data from the balise. In this connection, for example, limit balises are recognized too late, resulting in a delayed response.

(b) Scenario 2:

The route is equipped for ETCS Level 1, the secondary EVC and the driver's cab display are connected to each other via a bus.

If there is access to the data of the balise antenna at the head of the vehicle, the same modes are provided as in the primary EVC.

However, if there is no access to the data of the balise antenna at the head of the rail vehicle, significantly reduced monitoring of the secondary EVC is provided. Thus, preferably only one predefined maximum speed and one temporary speed restriction are monitored.

As data from the route is not captured at the head of the rail vehicle, a response may occur too late; the train control function is limited accordingly.

(c) Scenario 3:

The secondary EVC can be used as the source for the speed signal regardless of the ETCS level. In this respect, the speed information from the secondary EVC can be displayed on the driver's cab display of the carriage which has the primary ETCS system.

If a display component in the driver's cab display of the carriage with the primary ETCS system fails, the remaining display can be used to display the necessary information for safe operation of the train. Preferably a summarized presentation of the information can be selected for this or it is possible to switch between various views.

If a GSM-R module of the primary ETCS device fails, the GSM-R module of the secondary ETCS device can be used, if necessary by means of the secondary EVC.

Figure 2:
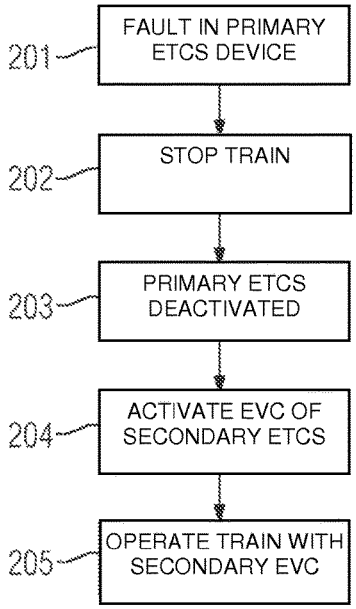
FIG. 2 exemplary switching between ETCS devices, in particular EVCs of the ETCS devices, on the basis of a flow chart.

FIG. 2 illustrates exemplary switching between ETCS devices, in particular EVCs of the ETCS devices, with reference to a flow chart.

In a step 201 a fault in the primary ETCS device is ascertained, the rail vehicle is slowed to a standstill in a step 202. In a step 203 the primary ETCS device is at least partially switched to an inactive state (e.g. switched off, isolated) and in a step 204 the previously sleeping EVC of the secondary ETCS device is activated. In a step 205 the rail vehicle is operated by means of the secondary EVC. Such operation of train control functionality can take place to a varying extent e.g. depending on the ETCS level.

Fail safety may be reduced as a result of the autonomous design of the primary and secondary ETCS devices.

The proposed solution thus enables an ETCS device integrated into rail vehicles, which until now has only been carried purely passively in "sleeping" mode, to now provide backup functions when the primary ETCS device (or part thereof) fails and thus to operate as a redundant system with full or reduced backup function.

An advantage is that the availability of technical train control by ETCS in trains with several ETCS devices is significantly increased and as a result reversion to backup on the basis of operational regulations with staff responsibility is reduced, increasing the safety of the whole system.

Although the invention was illustrated and described in more detail by the at least one exemplary embodiment shown, the invention is not limited thereto and other variations can be derived therefrom by the person skilled in the art without departing from the scope of the invention.

LIST OF REFERENCE CHARACTERS

101 Rail vehicle
102 Direction of travel
103-106 ETCS (vehicle) device
107 Electrical connection of the ETCS devices and/or EVCs, e.g. in the form of a bus system
108-111 EVC (computer of the ETCS device)
201-205 Steps of a method for using a secondary ETCS device and/or a computer of the secondary ETCS device

The invention claimed is:

1. A method for operating a train, the method comprising the following steps:

providing a primary train control device having a primary computer and a driver's display, and a secondary train control device having a secondary computer, wherein the primary train control device is located on one locomotive of a train consist and the secondary train control device is located on another locomotive of the train consist;

using the primary computer in connection with the primary train control device to control the train;

in response to a fault, switching from the primary computer to the secondary computer; and using the secondary computer together with the driver's display of the primary train control device to control the train.

2. The method according to claim 1, wherein the fault includes at least one of the following:

a failure of a component of the primary train control device; or a fault message regarding the primary train control device.

3. The method according to claim 1, which further comprises, in reponse to the fault, switching at least parts of the primary train control device to an isolated state in which the parts of the primary train control device are inactive, and shifting the secondary computer from a sleeping state to an active state.

4. The method according to claim 3, which further comprises switching the primary train control device to the isolated state and signaling the isolated state to the secondary computer.

5. The method according to claim 4, which further comprises carrying out the step of signaling the isolated state to the secondary computer via a bus system, a circuit or a radio connection.

6. The method according to claim 1, which further comprises:

slowing down the train in response to the fault;

when the train is stationary, switching at least parts of the primary train control device to an isolated state in which the parts of the primary train control device are inactive using train control isolation switches and interrupting a train control connection to an train control radio block center.

7. The method according to claim 6, which further comprises carrying out the step switching at least parts of the primary train control to the isolated state by inactivating the parts of the primary train control except for a recording unit and the driver's cab display device, when the train is stationary.

8. The method according to claim 1, which further comprises using the secondary computer to operate the train by providing at least one functionality selected from the group consisting of:

monitoring a highest admissible speed of the train, and monitoring a highest admissible speed of a route.

9. The method according to claim 8, which further comprises carrying out the step of monitoring the highest admissible speed of the route based on external specifications.

10. The method according to claim 1, which further comprises providing a balise antenna at a head of the train relative to a direction of travel of the train, being used by the secondary computer for operation of the train.

11. The method according to claim 10, which further comprises , when the balise antenna at the head of the train cannot be used, providing another balise antenna of the train and using the other balise antenna with the secondary computer for operation of the train.

12. The method according to claim 11, which further comprises providing reduced backup functionality for operation of the train by using the secondary computer.

13. The method according to claim 12, which further comprises using the secondary computer in a train control mode for the reduced backup functionality.

14. A train, comprising:

a primary train control device having a primary computer and a driver's display;

a secondary train control device having a secondary computer;

said primary train control device being configured to be switched to an inactive state in response to a fault in said primary train control device;

said secondary computer being configured to be activated to control the train in response to the fault together with said driver's display of said primary train control device; and wherein said primary train control device is located on one locomotive of a train consist and said secondary train control device is located on another locomotive of the train consist.

15. In a train having a primary train control device located on one locomotive of a train consist, wherein the primary train control device has a driver's display, the improvement comprising:

a secondary train control device with a secondary computer, said secondary train control device located on another locomotive of the train consist, said secondary train control device configured to receive an activation message in reponse to a fault in said primary train control device and to be activated to control the train in connection with said driver's display of said primary train control device after the primary train control device has deactivated in reponse to the fault.

* * * * *